United States Patent [19]

Nakaoka et al.

[11] 3,992,826

[45] Nov. 23, 1976

[54] APPARATUS FOR AUTOMATICALLY DETECTING AND ELIMINATING FLAWS ON SLABS OR BILLETS

[75] Inventors: Eiichi Nakaoka; Takeharu Maekawa; Masahide Tokunaga; Shozo Morishima, all of Kyoto, Japan

[73] Assignee: Shimadzu Seisakusho Ltd., Kyoto, Japan

[22] Filed: Apr. 8, 1975

[21] Appl. No.: 566,672

[30] Foreign Application Priority Data

Oct. 15, 1974 Japan ..... 49-119007

[52] U.S. Cl. ..... 51/35; 51/165.72; 144/2 M

[51] Int. Cl.[2] ..... B24B 7/02

[58] Field of Search ..... 51/35, 165.72, 165 TP, 51/165 R; 144/2 M, 310

[56] References Cited

UNITED STATES PATENTS

| | | | |
|---|---|---|---|
| 3,547,170 | 12/1970 | Maxey | 144/310 |
| 3,708,920 | 1/1973 | Kaszuba | 51/35 X |
| 3,822,632 | 7/1974 | Chigiotti | 144/2 M |

FOREIGN PATENTS OR APPLICATIONS

| | | | |
|---|---|---|---|
| 270,192 | 3/1927 | United Kingdom | 144/2 M |

*Primary Examiner*—Harold D. Whitehead
*Attorney, Agent, or Firm*—Fidelman, Wolffe & Waldron

[57] ABSTRACT

Apparatus for automatically detecting and eliminating flaws on slabs or billets which comprises a single flaw detector for successively scanning the surfaces of objects to be examined to produce detection signals corresponding to the flaws detected on the objects; a plurality of storage units each of which separately stores the detection signals obtained from scanning of one of said objects; and a plurality of flaw eliminators to each of which one of said objects that have been scanned by said detector is transferred so that each of said eliminators scans the surface of said transferred object to eliminate the flaws thereon in accordance in the detection signals stored in the corresponding one of said storage units.

6 Claims, 6 Drawing Figures

APPARATUS FOR AUTOMATICALLY DETECTING AND ELIMINATING FLAWS ON SLABS OR BILLETS

This invention relates to an apparatus for automatically detecting and eliminating defects or flaws on or in the surface of an object such as an iron or steel plate commonly referred to as a slab and an iron or steel bar commonly referred to as a billet.

Detection and subsequent elimination of defects or flaws in slabs or billets, which are essential for supervision of the quality of the iron and steel products, are generally conducted mannually by workers. The inefficiency of such manual work, however, causes a bottleneck in the process of manufacturing iron and steel products.

There have been proposed various methods and devices for detecting and eliminating such flaws from the material. Since detection of flaws requires a different type of work from elimination thereof, the devices for these two types of work have been separetely developed. For example, in the detection process workers visually inspect the surface of a slab or a billet and put a marking on any defect they have detected, after which the slab or billet is conveyed by means of a crane to a grinding machine, which grinds the marked defects off from the slab or billet.

The accuracy with which the detection is conducted largely depends upon the skill and physical and mental fatigue of the worker and therefore varies with different workers. Moreover, with the relatively large size of the object under inspection, several workers are simultaneously engaged in the detection of flaws on a single object. This certainly is very inefficient. On the other hand, in the elimination work, keen attention is required so as not to overlook any marking, with resulting physical and mental fatigue caused to the workers.

Accordingly, it is one object of the invention to provide an apparatus for automatically detecting defects or flaws on slabs, billets and the like and eliminating them, wherein detection and subsequent elimination of flaws are operatively combined through the intermediary of a signal storing device, thereby accomplishing automation of the whole process from detection of flaws on the slabs and the like to e elimination thereof.

Another object of the invention is to provide an apparatus for automatically detecting defects or flaws on slabs, billets and the like and eliminating them, wherein a single flaw detector is operatively combined with a plurality of flaw eliminators so as to make the best use of the difference in efficiency or the speed of operation between the two types of machines.

Another object of the invention is to provide such an apparatus as aforesaid, wherein a single flaw detector is operatively combined with a plurality of flaw eliminators so that those of the eliminators which have finished elimination of flaws on a slab successively start eliminating operation on a new slab that has been scanned by the detector, thereby greatly improving the efficiency of the flaw detecting and eliminating apparatus.

The invention with its above and other objects will be more clearly understood from the following description of a preferred embodiment thereof with reference to the accompanying drawings, wherein:

FIG. 1 is a somewhat schematic top plan view of one embodiment of the invention;

FIG. 2*a* is a somewhat schematic top plan view of the flaw detector shown in FIG. 1;

FIG. 2*b* is a somewhat schematic top plan view of one of the flaw eliminators shown in FIG. 1;

Figure 1:
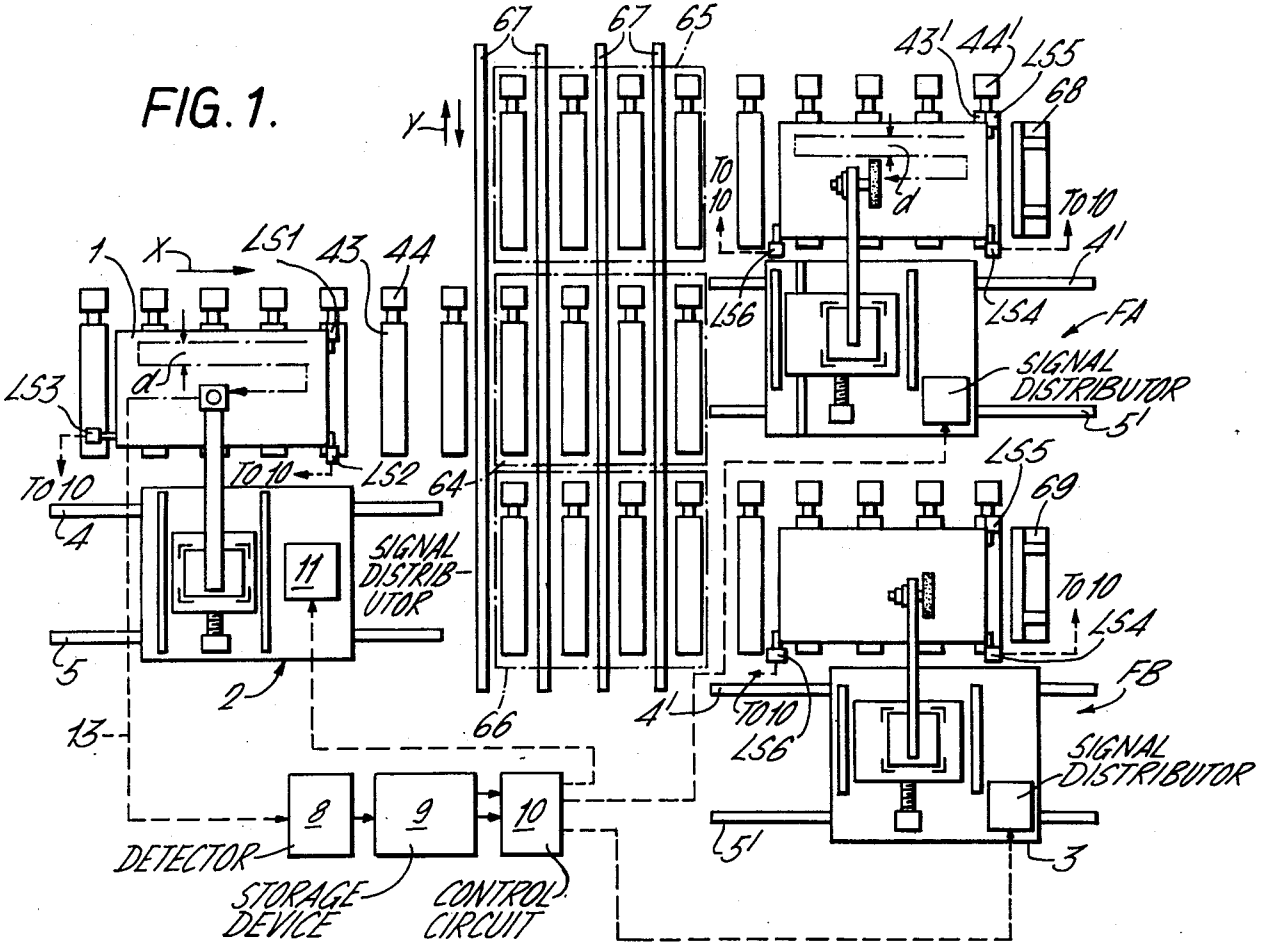

Referring first to FIG. 1, there is shown a slab 1 the flaws of which are to be detected and eliminated. The slab may be 1 meter wide, 10 meters long and 100 mm thick. The slab is first placed at a flaw detecting position from which after the detecting operation has been completed the slab is transferred to a flaw eliminating position. A flaw detector 8 has a detecting head H carried on a station or carriage 2. The head is reciprocable relative to the carriage 2 transversely of the slab in two opposite directions, and the carriage 2 also is reciprocable on and along a pair of rails 4 and 5. When the carriage comes to each of the opposite ends of the slab, the head H moves a predetermined distance or step *d*, so that the head H scans the surface of the slab in a zig-zag way as shown by a dot-and-dash line.

In the illustrated embodiment, the carriage 2 and the head H are moved, but the arrangement may be such that the head H and the slab are moved to provide the required zig-zag pattern of scanning.

Whenever the head H detects a defect or flaw on the slab, the detector 8 produces a detection signal, which is applied to a storage device 9 to be stored therein. The device 9 comprises a plurality, say, three storage units R1, R2 and R3 (FIG. 5) of the same construction each including a recording medium such as a magnetic tape or drum for storing the detection signal as will be described later in detail.

There are provided a plurality, say, two flaw eliminators FA and FB each having a grinder G carried on a carriage 3. The slabs the flaws of which have been detected are transferred from the flaw detector to one of the flaw eliminators after another in the manner to be described later. In each flaw eliminator the grinder G is reciprocable relative to the carriage 3 transversely of the slab and the carriage is reciprocable on and along a pair of rails 4' and 5', so that the grinder G can accurately trace the zig-zag locus that has been followed by the detecting head H as shown by a dot-and-dash line.

As described above, in the illustrated embodiment there are provided a single flaw detector, two flaw eliminators and three flaw detection signal storage units. While a first slab is being scanned, the flaw detection signals are stored in one of the storage units. When the scanning of the slab has been finished, the slab is transferred to one of the flaw eliminators, say, FA, which performs grinding operation on the slab in accordance with the detection signals stored in the storage unit.

While the grinding operation is being performed on the first slab, the detector scans the surface of a second slab which has been brought to the flaw detecting position, with another one, say, R2 of the storage units storing the flaw detection signals produced by the detector. When the scanning of the second slab has been finished, this slab is transferred to the other flaw eliminator FB, which performs grinding operation on the second slab in accordance with the detection signals stored in the second storage unit R2. On the other hand, the detector is now scanning the surface of a third slab, with the third storage unit R3 storing the flaw detection signals produced by the detector.

In cooperation with the limit switches, relays and signal distributors which will be described later, a controller 10 controls the flaw detecting operation of the flaw detector, selective connection or allocation of the detector and the flaw eliminators to the flaw detection signal storage units, and subsequent flaw eliminating operation of the eliminators, as will be described later in detail.

For positioning of a slab for scanning of the surface thereof, transfer of the slab from the flaw detector to the flaw eliminator and positioning of the slab for elimination of the flaws therefrom, there are provided alongside the rails 4, 5 and 4', 5' a plurality of rollers 43, 43' driven by motors 44, 44' with a reduction gear, and between the flaw detector and the flaw eliminators there are provided three roller conveyer units 64, 65 and 66 arranged side by side, with or belt conveyers 67 extending transversely of the three roller conveyer units.

The roller conveyers 64 – 66 are movable relative to the belt conveyers 67 vertically (that is, perpendicularly to the plane of the drawing sheet) so that they are selectively raised above or lowered below the level of the belt conveyers 67. Alternatively, the belt conveyers may be so arranged as to be selectively raised above or lowered below the level of the roller conveyers.

The rollers 43, 43', 64, 65 and 66 are so designed as to convey the slab rightward in the figure as shown by an arrow X, and the belt conveyers 67 are so designed as to convey the slab upward or downward in the figure as shown by arrows Y.

It can be easily understood that by controlling the rollers 43, 43', 65 – 66 and the belts 67 in an appropriate relation to each other it is possible to transfer the slab that has been scanned by the flow detector to either one of the two flaw eliminators.

In FIG. 1 the numerals 68 and 69 designate stoppers for the slab at the grinding position. The stoppers may be vertically movable for transferring the slab from the flaw eliminating position to the next stage of the process.

While the detector is scanning the surface of a slab, the recording medium of one of storage units R1 – R3 is fed in synchronism with the movement of the detecting head H so as to record the flaw detection signals on the medium. When the scanning of the whole surface of the slab has been finished, the slab is transferred to one of the flaw eliminators as previously mentioned, whereupon the recording medium is fed in synchronism with the movement of the grinder over the surface of the slab so as to read the flaw detection signals from the medium. Therefore, when a certain detection signal has been read, the position of the grinder G coincides with that of the flaw that corresponds to the detection signal, whereupon the relative movement of the carriage 3 and the slab is temporarily stopped so that the grinder operates for a period of time necessary to grind the flaw off from the slab. After the flaw has been removed, the zig-zag movement of the grinder over the slab surface is resumed.

In order that the grinder G may exactly follow the same locus as the detecting head H, the head and the grinder are so arranged that at the start they are at a predetermined position on the respective carriages 2 and 3 (e.g. the upper side thereof as viewed in FIG. 1), and every time the carriages 2 and 3 come to each of the opposite ends of the slab, a limit switch is actuated to produce a signal to displace the detecting head and the grinder a predetermined distance *d* from the previous position.

Figure 2A:
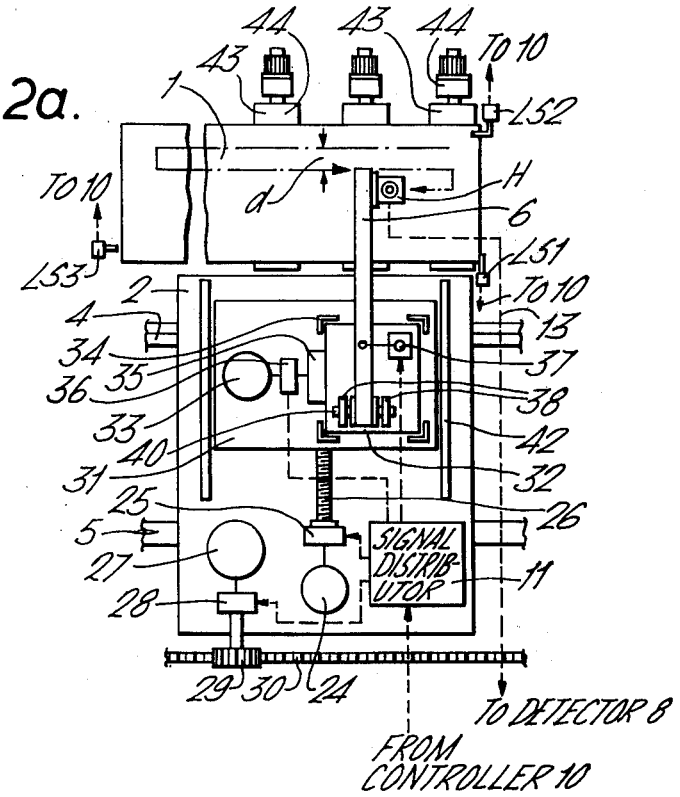
Figure 2B:
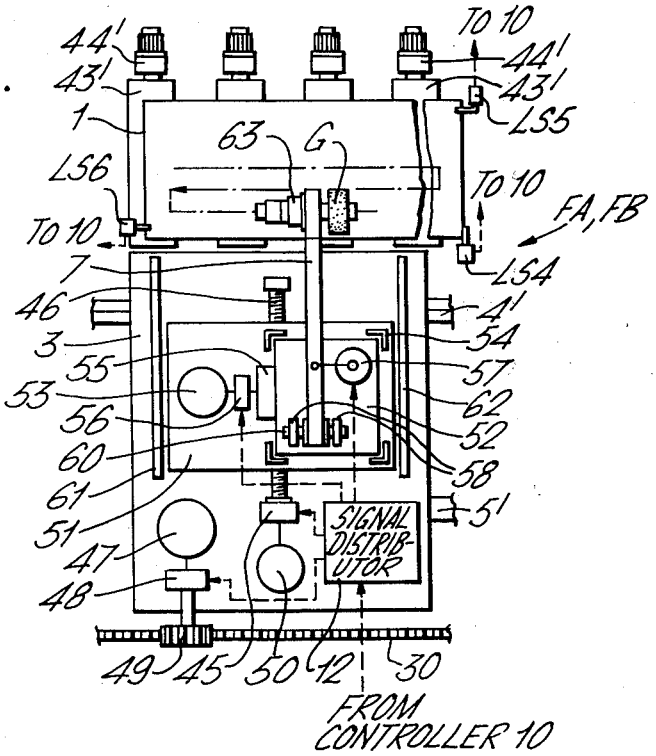

FIGS. 2*a* and 2*b* show the flaw detector and the flaw eliminators, respectively, in further detail. The two flaw eliminators are of the same construction, so that only one of them is shown in FIG. 2*b*.

As shown in FIG. 2*a*, the detecting head H is attached to the outer free end of a support arm 6, which is in turn mounted on the carriage 2 so that the arm and the detecting head H thereon are reciprocable transversely of the slab.

As shown in FIG. 2*b*, the grinder G is attached to the outer free end of a support arm 7, which is in turn mounted on the carriage 3 in the same manner as the arm 6 on the carriage 2. A drive motor 63 for the frinder G is also attached to the arm. With this arrangement it is possible to bring the detecting head H and the grinder G separately and individually to any position on the surface of the slab.

The carriage 2 reciprocates on the rails 4 and 5, and if at each of the opposite ends of the slab, the arm 6 is moved by a predetermined distance *d* transversely of the slab, the head H scans the whole surface area of the slab along way as zig-zag as shown by the dot-and-dash line in the figure. With a similar arrangement, the grinder G follows the same zig-zag way or locus as the head H previously traced so as to perform grinding operation where necessary on the slab.

The arm 6 carrying the detecting head H is not directly mounted on the carriage 2, but on a lifting member 32 provided on a slide 31. The arm 6 has its inner end pivotally connected to a pin 40 supported on a bracket 38 fixed to the lifting member 32, so that the head H is brought into soft contact with the surface of the slab by means of an air cylinder 37 acting on the arm 6.

The lifting member 32 is guided by a frame 34 and is vertically movable by means of a lifting device 35 driven by a motor 33 through a clutch 36, thereby accommodating slabs of different thicknesses.

The slide 31 carrying the lifting member 32 is movable on the carriage 2 transversely thereof, that is, in opposite directions perpendicular to the direction of the reciprocating movement of the carriage 2 on the rails 4 and 5. A pair of rails 41 and 42 guide the slide as it is moved by a feed screw 26 engaging a nut 70 (FIG. 3) fixed to the slide. The screw rod is driven by a motor 24 through a clutch 25. The transverse movement of the slide 31 is intermittently effected at the opposite ends of the length of the slab, so that with the carriage 2 reciprocating, the detecting head H scans the surface of the slab in the zig-zag manner as previously mentioned.

The reciprocating movement of the carriage 2 along the length of the slab is effected by a reversible motor 27 which rotates a pinion 29 engaging a rack 30 extending alongside the rails 4 and 5. A clutch 28 controls transmission of the rotation of the output shaft of the motor 27 to the pinion 29.

The control circuit 10 controls the above-mentioned operation of the flaw detector in a predetermined orderly manner through a signal distributor 11 in response to the operation of limit switches LS1, LS2 and LS3.

The detailed construction of the flaw eliminators will next be described with reference to FIG. 2*b*. As is obvious from the drawings, the flaw eliminators are of much the same construction as the flaw detector except for a single point to be described presently, so that the following comment will be sufficient for the flaw eliminators.

The reference numeral 30' in FIG. 2*b* designates a rack corresponding to the rack 30; the reference numeral 49, a pinion corresponding to the pinion 29; the numerals 48, 45 and 56, clutches corresponding to the clutches 28, 25 and 36, respectively; the numerals 47, 50 and 53, motors corresponding to the motors 27, 24 and 33, respectively; the numeral 46, a feed screw rod corresponding to the screw rod 26; the numeral 51, a slide corresponding to the slide 31 and guided by rails 61 and 62 corresponding to the rails 41 and 42; the numeral 52, a lifting member corresponding to the lifting member 32 and guided by a vertical frame 54 corresponding to the frame 34; the numeral 55, a lifting device corresponding to the device 35; and finally, the reference numeral 58, a bracket corresponding to the bracket 38, with a pivot pin 60 corresponding to the pin 40.

The only difference in the construction between the detector and the eliminator is that in the eliminator in order to grind off the flaw from the slab surface the grinder G must be pressed against the surface of the slab relatively strongly as compared with the detecting head H in soft contact therewith, so that a hydraulic cylinder 57 is preferred to the air cylinder 37 used in the detector.

The control circuit 10 controls the operation of the flaw eliminator in a predetermined orderly manner through a signal distributor 12 in response to the operations of limit switches LS4, LS5 and LS6 and the flaw signals read from the magnetic drum 16 in the storage unit R1, R2 or R3.

Figure 3:
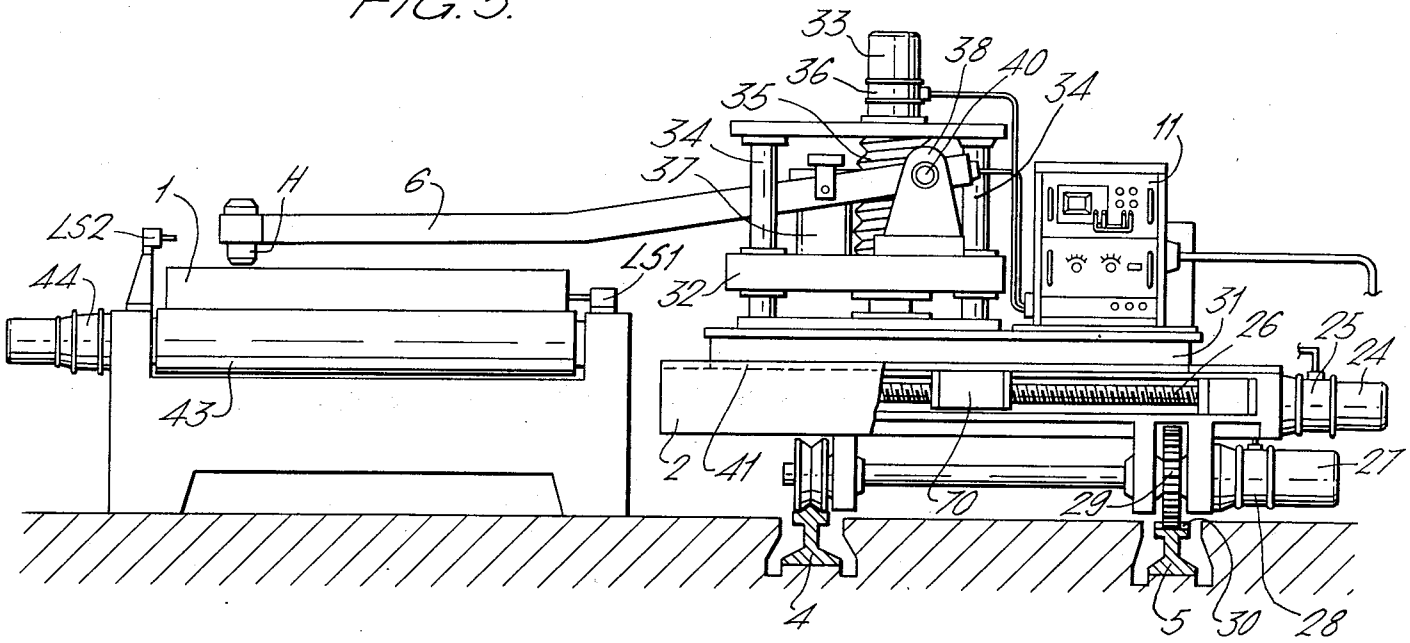
FIG. 3 is a side elevational view of the flaw detector shown in FIG. 2*a;*
Figure 4:
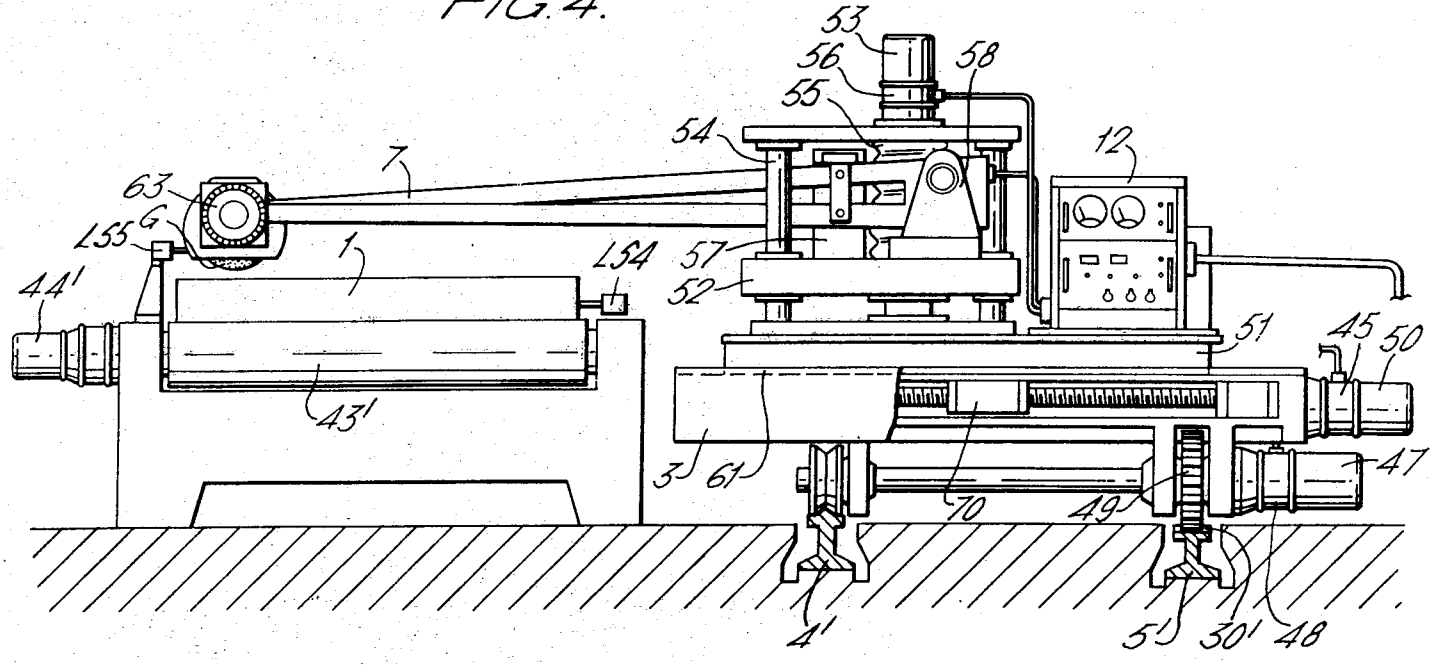
FIG. 4 is a side elevational view of the flaw eliminator shown in FIG. 2*b.

FIGS. 3 and 4 show the flaw detector and the flaw eliminator, respectively, in a more concrete form. In these figures the same reference numerals and symbols as in FIGS. 2*a* and 2*b* denote corresponding component parts and the construction and operation thereof are so obvious from the foregoing description thereof that no further explanation will be necessary.

Figure 5:
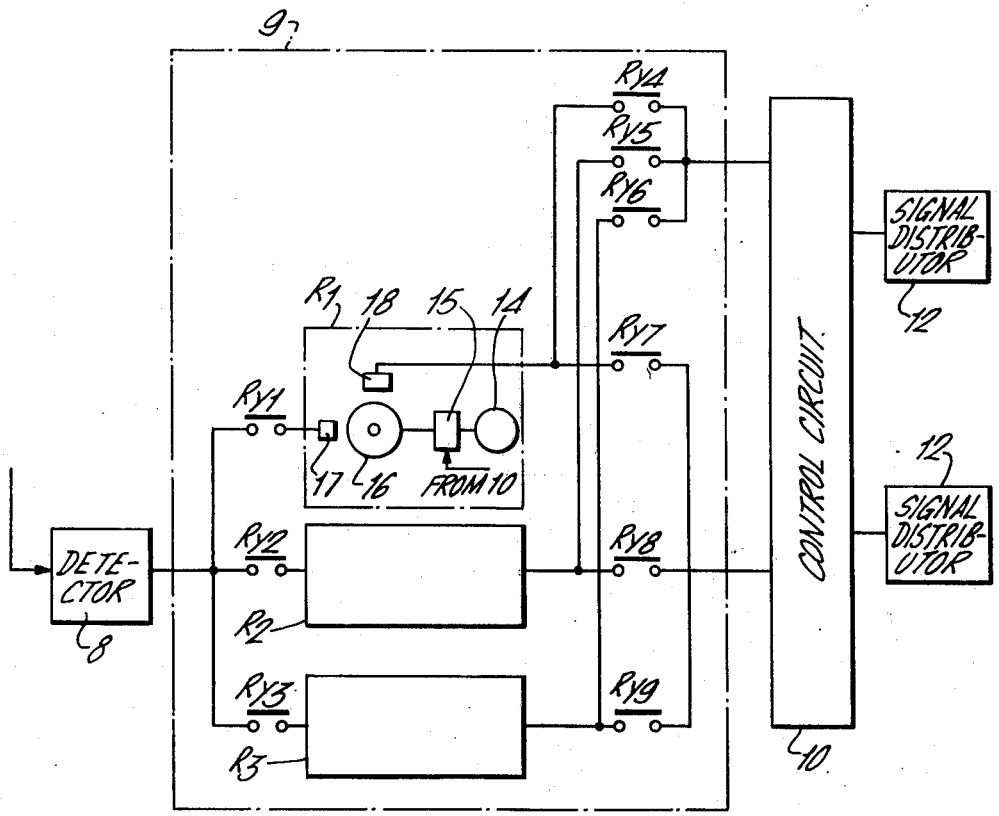
* and FIG. 5 is a block diagram of the flaw detection signal storage device of the apparatus of FIG. 1.

Turning to FIGS. 1 and 5, as previously mentioned, when the detecting head H has detected a flaw or defect on the slab surface, it applies a detection signal through a line 13 to the detector 8, which produces a flaw signal to be applied to one of the storage units, say, R1 in the storage device 9. While the head H is scanning the surface of the slab, the storage unit stores all the flaw signals received from the detector 8. When the detecting operation has been finished, the slab is transferred to one of the flaw eliminators, say, FA for elimination of the flaws, whereupon the storage unit R1 releases the stored flaw information in an orderly and successive manner to operate the eliminator FA to perform a grinding operation on the flaws on the slab along the same locus as was previously traced by the detecting head H and in the same order as the flaws were detected.

When the detecting head H scans the whole surface of the slab, the scanning speed may be constant. However, whenever a flaw signal is released from the storage unit, the grinder operating in response thereto must temporarily stop for grinding the adjacent area of the flaw on the slab surface. Therefore, the storage unit also must temporarily stop whenever it releases a stored flaw signal and wait till the grinding operation is finished.

To enable this, the storage units may be designed, for example, as shown in FIG. 5. The storage units are of the same construction and operates in the same way, so that the component parts of the unit R1 alone are shown in FIG. 5, with the other units R2 and R3 being shown as a mere block. A magnetic drum 16 is rotated through a clutch 15 by a motor 14 in the direction of the arrow in synchronism with the movement of the detecting head H. As the head H moves, the drum 16 is rotated for an angle corresponding to the distance that has been travelled by the head H. A recording or writing head 17 receives flaw signals from the detector 8 and magnetically records them on the surface of the drum, so that the pattern of flaws on the whole surface of the slab can be recorded on the surface of the drum in a reduced scale. A reproducing or reading head 18 reads the flaw signals written on the drum and applies them to the control circuit 10 for operation of the grinder G of the flaw eliminator FA or FB.

Whenever a flaw signal is read from the drum 16, the clutch 15 is operated to temporarily stop the rotation of the drum, and when the flaw has been ground off, the clutch 15 is restored to rotate the drum again.

A relay contact Ry1 is interposed between the detector 8 and the first storage unit R1; a relay contact Ry2, between the detector 8 and the second storage unit R2; a relay contact Ry3, between the detector 8 and the third storage unit R3; relay contacts Ry4 and Ry7, between the first storage unit and the control circuit 10, relay contacts RY5 and RY8, between the second storage unit and the control circuit 10, and relay contacts Ry6 and Ry9, between the third storage unit and the control circuit. This arrangement enables control of selective connection or allocation of the detector 8 to the three storage units and that of the storage units to the flaw eliminators FA and FB. In other words, while two of the three storage units are releasing the flaw signals previously stored therein to actuate the grinders G of the two flaw eliminators to perform grinding operation on two slabs, the third storage unit can record flaw signals from the detector scanning a third slab, thereby improving the working efficiency of the apparatus.

The operation of the above-mentioned relay contacts is controlled by the operation of the limit switches LS1 to LS6 through the control circuit 10. The switch LS1 is actuated by the slab that has arrived at the flaw detecting position to produce a signal; and the switch LS2 is actuated by the detecting head H at its start position to produce a signal. That is, the switches LS1 and LS2 control the start of the flaw detecting operation, with the switch LS3 controlling the completion of the detecting operation. The signals from the switches are applied to the control circuit 10.

Similarly, the limit switch LS4 detects the slab having arrived at the flaw eliminating position in each of the flaw eliminators to produce a signal; and the switch LS5 is actuated by the grinder G at its start position to produce a signal. That is, the switches LS4 and LS5 control the start of the flaw eliminating operation, with the switch LS6 controlling the completion of the eliminating operation. The signals from these switches are applied to the control circuit 10.

When the switches LS1 and LS2 are actuated to start the scanning operation of the head H on a first slab, one of the relay contacts, say, Ry1 is closed. The closure of the contact Ry1 connects the writing head 17 of the first storage unit R1 to the detector 8, so that with the clutch 15 having been operated to rotate the drum 16, the head 17 writes flaw signals received from the detector 8 successively on the surface of the drum 16. When the switch LS3 is actuated upon completion of the scanning operation of the head H, the contact Ry1 is opened and the clutch 15 is restored to stop the rotation of the drum 16.

Then the first slab is transferred to one of the two flaw eliminators, say, FA, and the grinder G is brought to its start position, whereupon the switches LS4 and LS5 are actuated. This causes the contact Ry4 to be closed and the clutch 15 to be actuated, so that whenever the reading head 18 reads a stored flaw signal, the clutch 15 is restored to temporarily stop the rotation of the drum 16 and the read flaw signal is sent through the control circuit 10 to the signal distributor 12 of the flaw eliminator FA so as to cause the grinder G to grind off the flaw on the slab corresponding to the read flaw signal. When all the flaws have been eliminated in the above manner and the grinder G has come to actuate the switch LS6, the contact Ry4 is opened. The slab is removed from the eliminator FA.

While the grinder G of the flaw eliminator FA is performing grinding operation on the first slab, a second slab is being scanned by the detecting head H so that the flaw signals obtained from the second slab are recorded on the magnetic drum 16 of another, say, R2 of the storage units, with the contact Ry2 being controlled by the limit switches LS1 to LS3 in the above-mentioned manner.

When the scanning of the second slab has been completed, the limit switch LS3 is actuated and the relay contact Ry2 is opened. Then the second slab is transferred to the other flaw eliminator FB and the grinder G thereof is brought to its start position, whereupon the limit switches LS4 and LS5 are actuated. This causes the relay contact Ry8 to be closed and the clutch 15 in the second storage unit R2 to be actuated, so that as the flaw signals stored in the storage unit are read out, they are sent through the control circuit 10 to the signal distributor 12 of the second flaw eliminator FB so that the grinder G thereof grinds off the flaws on the slab corresponding to the read flaw signals.

When all the flaws on the second slab have been eliminated and the grinder G of the flaw eliminator FB has come to actuate the limit switch LS6, the relay contact Ry8 is opened and the slab is removed from the eliminator FB.

While grinding operation is being performed on the first and second slabs in the above-mentioned manner, the detecting head H of the flaw detector scans the surface of a third slab, with the relay contact Ry3 having been closed so that the storage unit R3 stores the flaw detection signals received from the detecting head.

When either of the two eliminators FA and FB has finished elimination of all the flaws on the first or second slab earlier than the other eliminator, the third slab the flaws of which have now been detected is transferred to that eliminator, with the storage unit R3 which has stored the information of the detected flaws having been connected to the eliminator, while the storage unit R1 or R2 the stored information of which has been used for the finished elimination of the flaws on the first or second slab is used to store the information about the flaws which will be detected on a fourth slab.

In this way, the single flaw detector, the two flaw eliminators and the three storage units are all operating at all times thereby greatly improving the working efficiency of the apparatus, and this is accomplished by appropriately controlling the contacts Ry1 to Ry9 by means of a control circuit 10 which operates in response to the operation of the limit switches LS1 to LS6.

It should be noted that the two limit switches LS1 and LS2, and LS4 and LS5 may be replaced by a single limit switch having a function equivalent to those of the two limit switches.

Generally speaking, a single flaw detector may be combined with a plurality, say, $n$ eliminators and at least $(n + 1)$ storage units, $n$ being set to a suitable number in view of the efficiency of the flaw detector and that of the flaw eliminator and also the expected average number of flaws to be detected on the slab.

The operation of the circuit of FIG. 5 is now clear to those who have read the foregoing description so that a few more lines will be sufficient for full understanding thereof.

Suppose now that the two flaw eliminators FA and FB are now conducting grinding operation on a first and a second slab on the basis of the flaw information shored in, say, the storage units R1 and R2, respectively, with the contacts Ry4 and Ry8 being closed, and that the storage unit R3 has now stored the flaw information of a third slab that has been scanned by the detecting head H. Under the condition, if the eliminator FB has finished the grinding operation on the second slab earlier than the eliminator FA, the third slab is transferred to the eliminator FB and the storage unit R3 is connected to the signal distributor 12 of the eliminator FB by closing the contact Ry9, so that the eliminator FB conducts grinding operation on the third slab. On the other hand, with the contact Ry2 having been closed, the storage unit R2 is now storing flaw signals received from the detector 8 as the head is scanning a fourth slab.

It should be noted that the drive systems for the detecting head H and the configurations of the component parts of the apparatus are not restricted to those described in the foregoing and illustrated in the drawings, but there may be various modifications thereof. Also the apparatus can employ any suitable method of detecting flaws on the object to be examined, provided that the result of detection can be obtained in the form of an electrical signal. For example, eddy current, supersonic, magnetic and optical detecting methods can be employed in the invention.

As described above, the invention makes the best use of the functional difference between the flaw detector and the flaw eliminator and organically combine them to automate the whole process from the detection of flaws to the elimination thereof. In particular, in order to balance the efficiency of the flaw detector and that of the flaw eliminator, the invention combines a single detector with a plurality of eliminators through the intermediary of a plurality of signal storage units, so that a maximum of efficiency has been attained. Through automation of the whole process the apparatus of the invention alleviates physical and mental fatigue of the workers and contributes to supervision of the quality of the products at a minimum cost.

We claim:

1. Apparatus for detecting flaws in a generally flat surface on a stationary object such as a metal slab or a billet and eliminating said flaws, comprising: a flaw detector for detecting flaws on or in said surface and producing a flaw signal for each flaw detected; means for effecting relative movement of said flaw detector over said surface under inspection so that said flaw detector traverses and scans said surface of said stationary object along a predetermined locus; a plurality of storage units for ordered storing of said flaw signals, each of said storage units storing the flaw signals resulting from scanning of one said surface by said flow detector; a plurality of flaw eliminators for eliminating said flaws detected by said flaw detector; means for allocating each of the objects that have been scanned by said detector and the corresponding one of said storage units which has stored the flaw signals resulting from scanning of each said object to a selected one of said flaw eliminators; and means for effecting relative movement of said selected flaw eliminator over said object allocated thereto so that said selected eliminator traverses the surface of said allocated object, following said predetermined locus over said surface; and said selected eliminator operates at positions along said predetermined locus in response to said ordered flaw signals stored in said storage unit allocated thereto, said signals to operate said selected eliminator occurring at a position along said predetermined locus corresponding to the position along said predetermined locus where said signal was produced by said flaw detector, whereby said flaws are eliminated by said selected eliminator from said respective allocated objects.

2. The apparatus of claim 1, wherein the number of said eliminators is $n$ and the number of said storing units is at least $(n + 1)$, so that while $n$ eliminators are operated by the signals from $n$ storing units, the remaining at least one storing unit is operating to store flaw signals from said detector scanning a further object.

3. The apparatus of claim 2, wherein said allocating means operates so as to allocate the latest object that has been scanned by said detector and the corresponding storing unit that stores the result of scanning of said latest object to that one of said eliminators that has earliest finished the eliminating operation on the previous object.

4. The apparatus of claim 1, wherein said flaw eliminators include a grinder for grinding off said flaws from said objects.

5. The apparatus of claim 1 wherein said selected eliminator stops in said traverse along said predetermined locus at said signaled positions while said selected eliminator operates to eliminate a flaw.

6. The apparatus of claim 1 wherein said detector produces an electrical signal when scanning a flaw.

* * * * *